United States Patent [19]

Newman et al.

[11] 4,269,395

[45] May 26, 1981

[54] PORTABLE HYDRAULIC RIG FOR PERFORMING WORKOVER, DRILLING AND OTHER OPERATIONS ON A WELL

[76] Inventors: James L. Newman, 970 Stacewood Dr., Beaumont, Tex. 77707; Harold D. Lee, 2710 Lakeview Cir., Beaumont, Tex. 77703

[21] Appl. No.: 923,101

[22] Filed: Jul. 23, 1978

[51] Int. Cl.[3] ..... B66C 23/60

[52] U.S. Cl. ..... 254/386; 173/147; 52/115; 254/399; 254/281

[58] Field of Search ..... 254/139.1, 139, 143, 254/148, 188, 189, 190 B; 173/147, 149, 143, 167; 52/69, 123, 122, 188, 115

[56] References Cited

U.S. PATENT DOCUMENTS

| | | | |
|---|---|---|---|
| Re. 17,981 | 2/1931 | Bache | 254/190 B |
| 1,603,571 | 10/1926 | Zerbe et al. | 254/190 B |
| 2,742,260 | 4/1956 | Patterson | 254/139.1 |
| 3,033,527 | 5/1962 | Wilson | 254/139.1 |
| 3,960,360 | 6/1976 | Elliston | 254/139.1 |

*Primary Examiner*—Robert J. Spar
*Assistant Examiner*—Kenneth Noland
*Attorney, Agent, or Firm*—Pravel, Gambrell, Hewitt, Kirk, Kimball & Dodge

[57] ABSTRACT

A new and improved portable hydraulic rig for performing workover, drilling or other operations on a well, usually a petroleum well, wherein the rig has a telescoping mast for telescoping to a reduced length for transportation, wherein the mast is cantilevered in use so that the travelling block moves vertically at one side of the mast, wherein the cable for the travelling block is reeved over the various sheaves including a sheaves on a hydraulic power assembly with the dead end of the line being fastened at or in proximity to the rig floor for balanced loading on the legs of the mast and to enable slack in the cables to be taken up when telescoping the mast.

19 Claims, 15 Drawing Figures

3
72
70'
74
15
6
H
A
14
12
90
74b
74a
M-1
11
L
72a
10
2
19
21
91
R
61
K-1
62
20
M
M-2
P-1
K-2
T-2
T-1
T
30
P-2
22a
31
22
32
78
80
V
F
W
35
17
18
48a
48
40
43
49

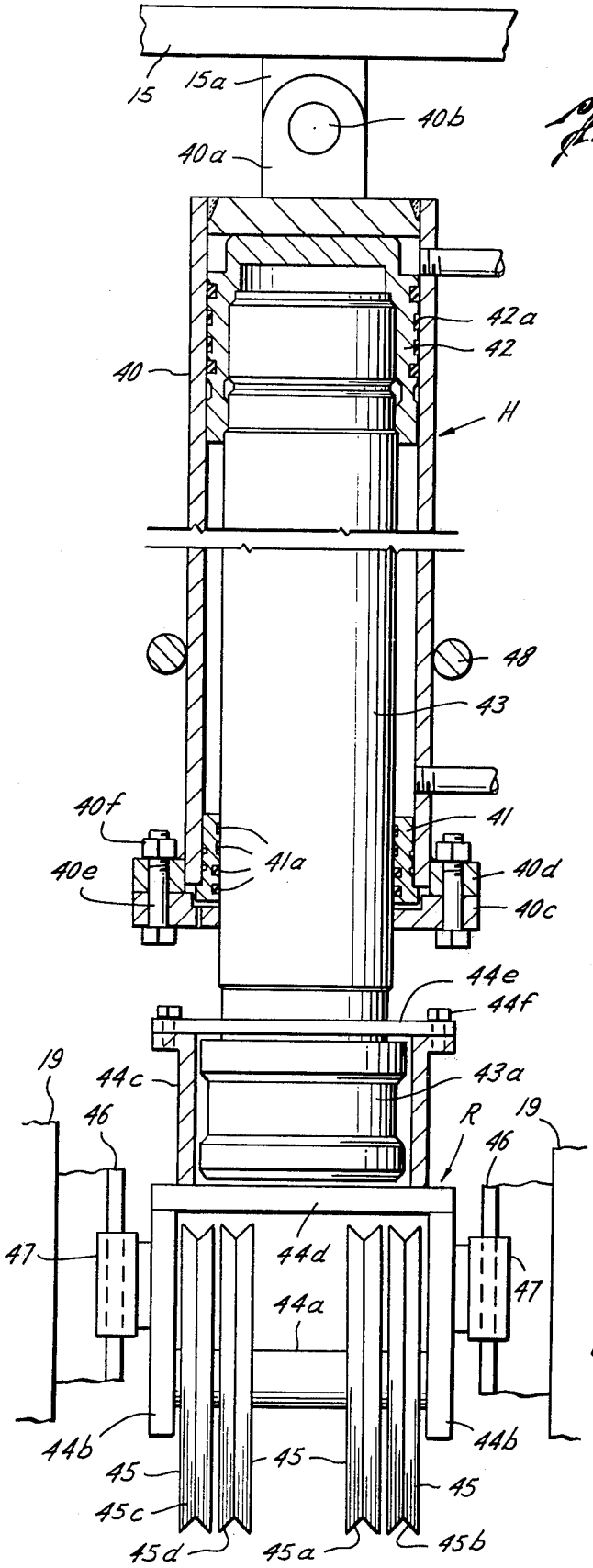
Fig. 6
Fig. 7
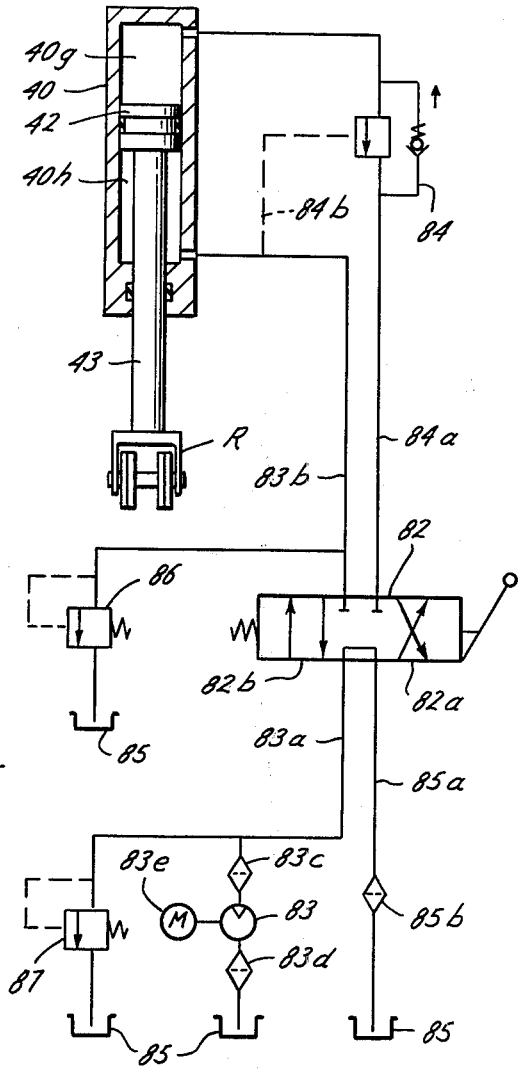

74
70'
72
M
62
10
10
61
K-2
P-1
30
P-2
R
W
80
F
A
22
22a
31
32
L
V

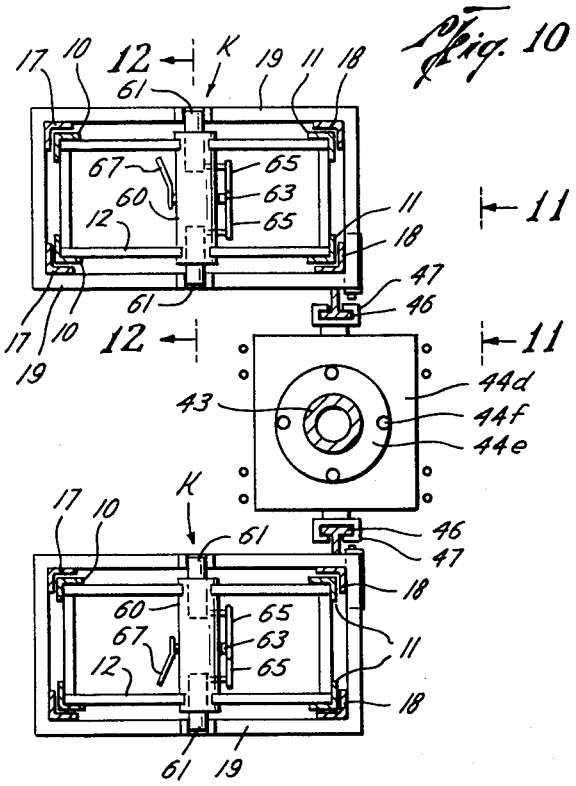
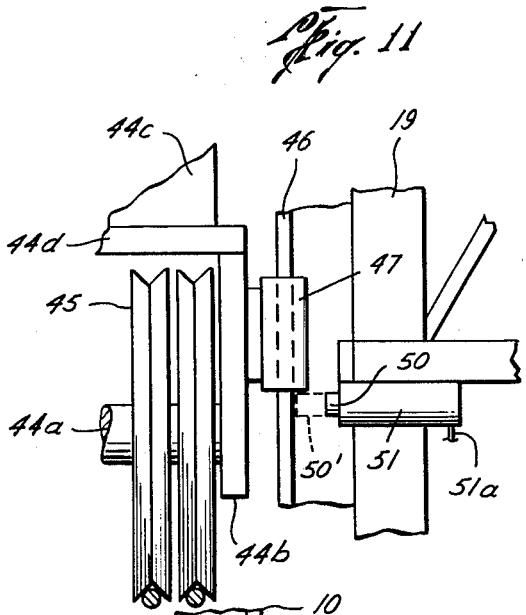
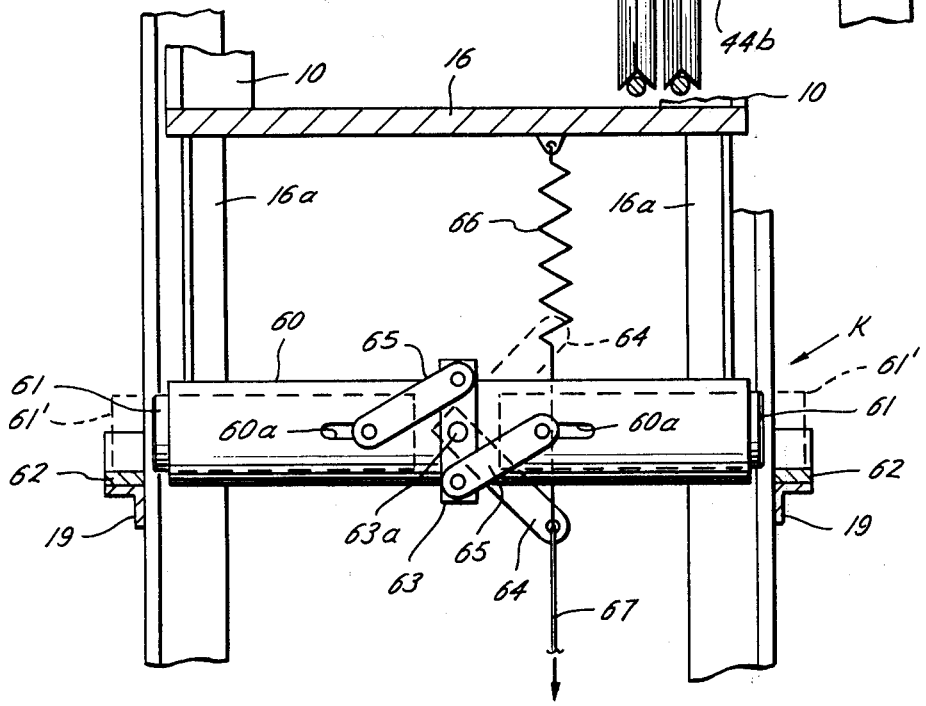
Fig. 12

72
70
74
110
14
12
M'-1
F
19
62
K-1
91
M'
L-1
19
20
M'-2
112
T
K-2
62
30
22
22a
32
31
92
H'
143
90
85
145
14
90
140
82
81
P
80
80
14

H'
145
85
84
145
84
140
82
81
P
80

PORTABLE HYDRAULIC RIG FOR PERFORMING WORKOVER, DRILLING AND OTHER OPERATIONS ON A WELL

BACKGROUND OF THE INVENTION (PRIOR ART STATEMENT UNDER RULES 1.97 AND 1.98)

In the past, rigs for workover, drilling and other operations employing hydraulic power assemblies instead of a drawworks for raising and lowering a travelling block have been used. The closest prior patents known to the applicant are U.S. Pat. Nos. 3,089,550; 3,719,238; and 3,960,360 (copies are filed herewith) and the art cited therein. In addition, applicant is aware of a prior rig used in 1974 shown in drawing No. 1703-A, filed herewith.

The present invention differs from such prior art in that the present rig is adapted to be extended and telescoped for reducing its length during transportation, utilizing the hydraulic system for such telescoping and extension. Further, the present invention is cantilevered from vertical to dispose the travelling block to one side of the mast, and the deadlines are secured to the rig floor or base for loading the rear legs of the mast. Also, by securing the deadlines to the rig floor or base, the line can be reeled in or taken up when the mast is telescoped to thereby prevent tangling of the lines during such telescoping.

SUMMARY OF THE INVENTION

The present invention relates to a new and improved portable hydraulic rig, wherein a hydraulic assembly is provided instead of a drawworks for raising and lowering a travelling block relative to the rig mast. The mast is adapted to telescope and extend, utilizing the hydraulic assembly for such purpose. The mast is cantilevered to dispose the travelling block to one side of the mast, and the deadlines are secured to the rig floor or base for loading the rear legs of the mast. The deadlines can be taken up upon telescoping of the mast. Also, the crown block assembly has in-line sheaves to hang the travelling block further forward, and to permit adjustment for different mast widths and sheave diameters.

BRIEF DESCRIPTION OF THE DRAWINGS

FIG. 6 is a view, partly in section and partly in elevation, illustrating the preferred hydraulic assembly and the mounting of same;

FIG. 7 is a schematic illustration of the preferred hydraulic system for the rig of the present invention;

FIG. 10 is a cross-sectional view taken on line 10—10 of FIG. 9 to illustrate a preferred embodiment for releasably seating the upper mast section on the lower mast section;

FIG. 11 is a partial view taken on line 11—11 of FIG. 10 to illustrate more details of the guide means preferably used for guiding the ram block relative to the lower mast section, and for also releasably connecting or pinning the ram block to the lower mast section at selected points;

FIG. 12 is a partial view, partly in section, taken on line 12—12 of FIG. 10 to illustrate more in detail the releasable latching means for releasably seating the upper mast section on the lower mast section;

DESCRIPTION OF THE PREFERRED EMBODIMENT

Figures 1, 2:
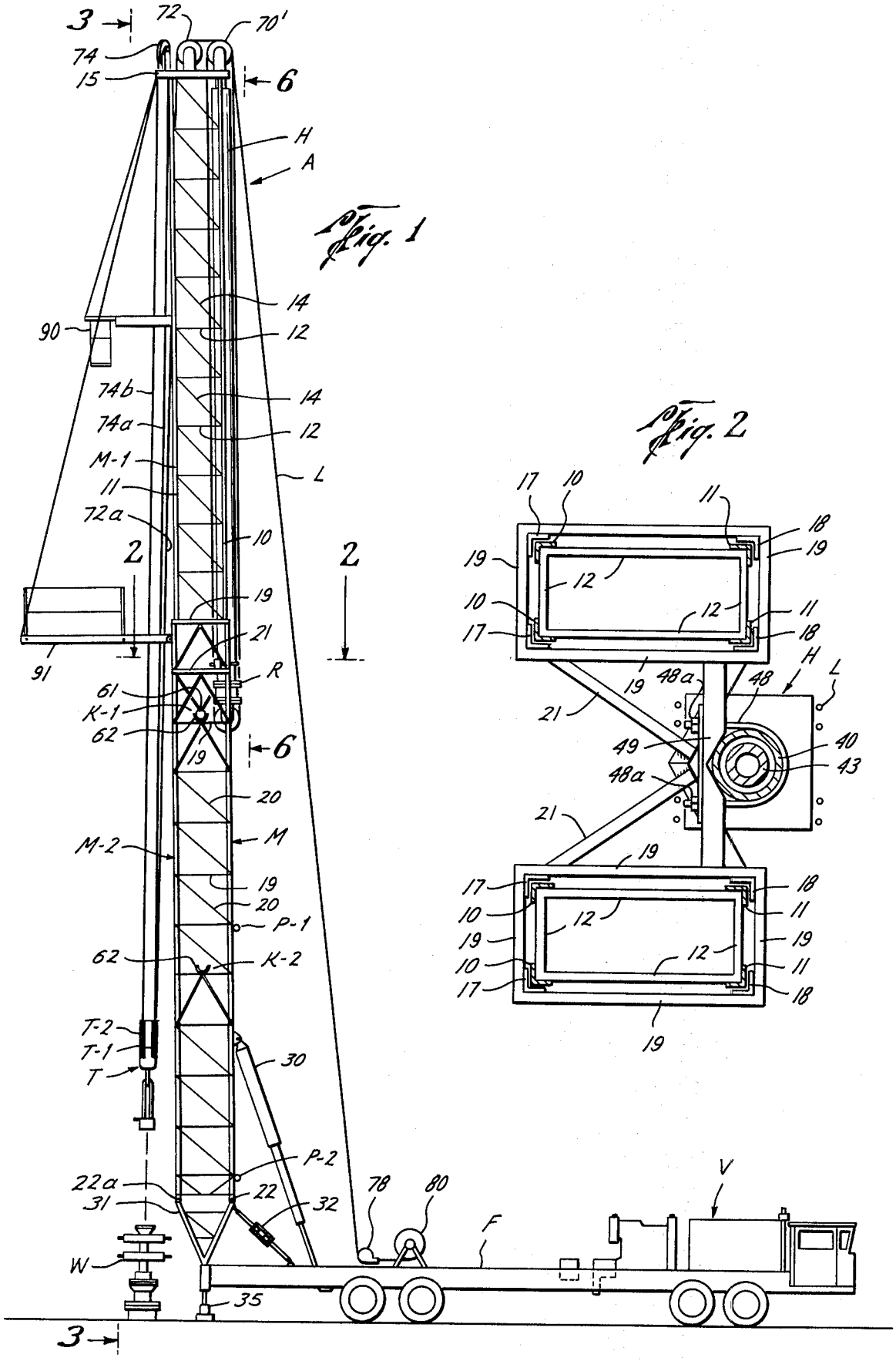
FIG. 1 is an elevation of the portable hydraulic rig of the present invention, in its position for conducting well operations, wherein the travelling block is raised and lowered, utilizing the hydraulic assembly instead of a drawworks.
FIG. 2 is a horizontal cross-sectional view taken on line 2—2 of FIG. 1.

In the drawings, the letter A refers generally to the rig of this invention which is suitable for performing workover, drilling or other operations on a well, usually a petroleum well. Briefly, the rig A includes a mast M which has an upper mast section M-1 and a lower mast section M-2 which are adapted to telescope and extend relative to each other, as will be more evident hereinafter. The mast M has a hydraulic system H therewith which has an operating line L mounted therewith and extending to a conventional travelling block T for the purpose of raising and lowering the travelling block T relative to the mast M. A vehicle V of any suitable configuration, usually in the nature of a truck having a bed or floor F is provided for the mounting of the mast M thereon so that when the mast M is in its telescoped position (FIG. 8), the entire rig A may be moved from one location to another.

Figure 3:
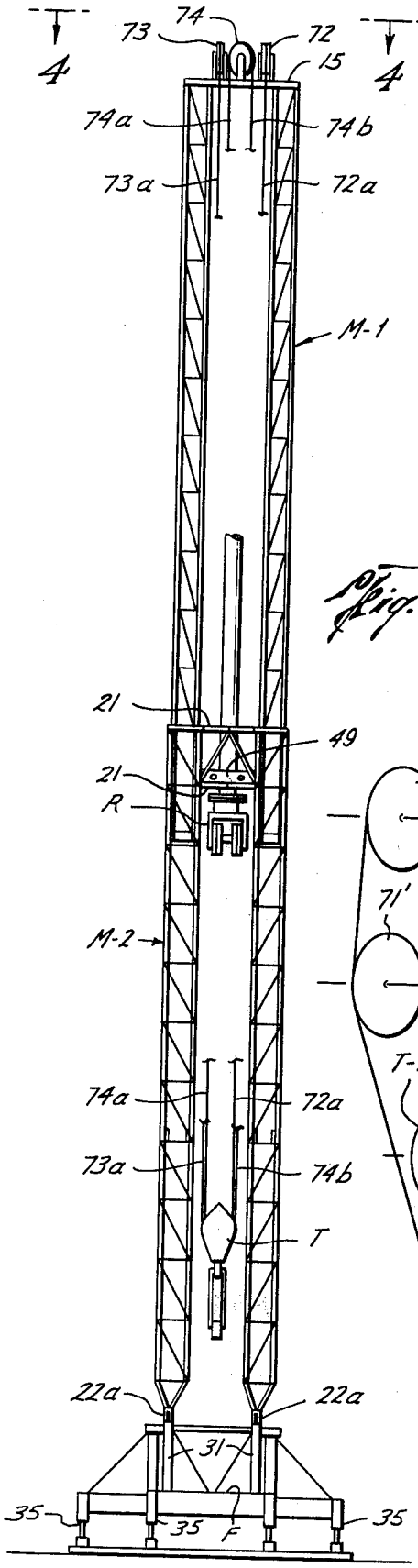
FIG. 3 is a front view taken on line 3—3 of FIG. 1, further illustrating the portable hydraulic rig of the present invention.

Considering the invention more in detail, reference is first made to FIGS. 1-3, wherein the structure of the mast M can be more readily seen. The upper mast section M-1 is preferably formed of two longitudinal mast leg units, each of which is substantially rectangular in cross-section (FIG. 2) and which is formed by a pair of longitudinally extending rear legs 10 and a pair of forward longitudinally extending legs 11 which are interconnected by rectangular bracing or frame members 12 and are also rigidified by angular bracing 14. The upper end of the upper mast section M-1 is interconnected and terminates in a crown plate or plates 15, the purpose of which will be more fully described hereinafter. The lower end of the upper mast section M-1 terminates in a plate or plates 16 which has mounted therewith a portion of a latch means K, the details of which will be described hereinafter (FIG. 12).

The lower mast section M-2 is made in a similar manner to the upper mast section M-1, except that it is of a larger dimension overall to receive the leg units of the upper mast section for longitudinally movement relative thereto. Thus, the lower mast section M-2 is likewise formed with two longitudinal mast leg units, each of which has front legs 17 extending longitudinally and rear legs 18 extending longitudinally and which are interconnected by a substantially rectangular horizontally disposed framework or frame members 19 and angular bracing 20. At or near the upper end of the two lower mast leg units of the lower mast section M-2, suitable interconnecting tie members 21 (FIG. 2) are secured. As can be seen in FIG. 2, such interconnecting members 21 are welded or are otherwise connected to the horizontal braces or frame members 19 and are angled so that they do not interfere with the travel of the travelling block T and also so as to receive the hydraulic assembly H, as will be more evident hereinafter.

Figures 8, 9:
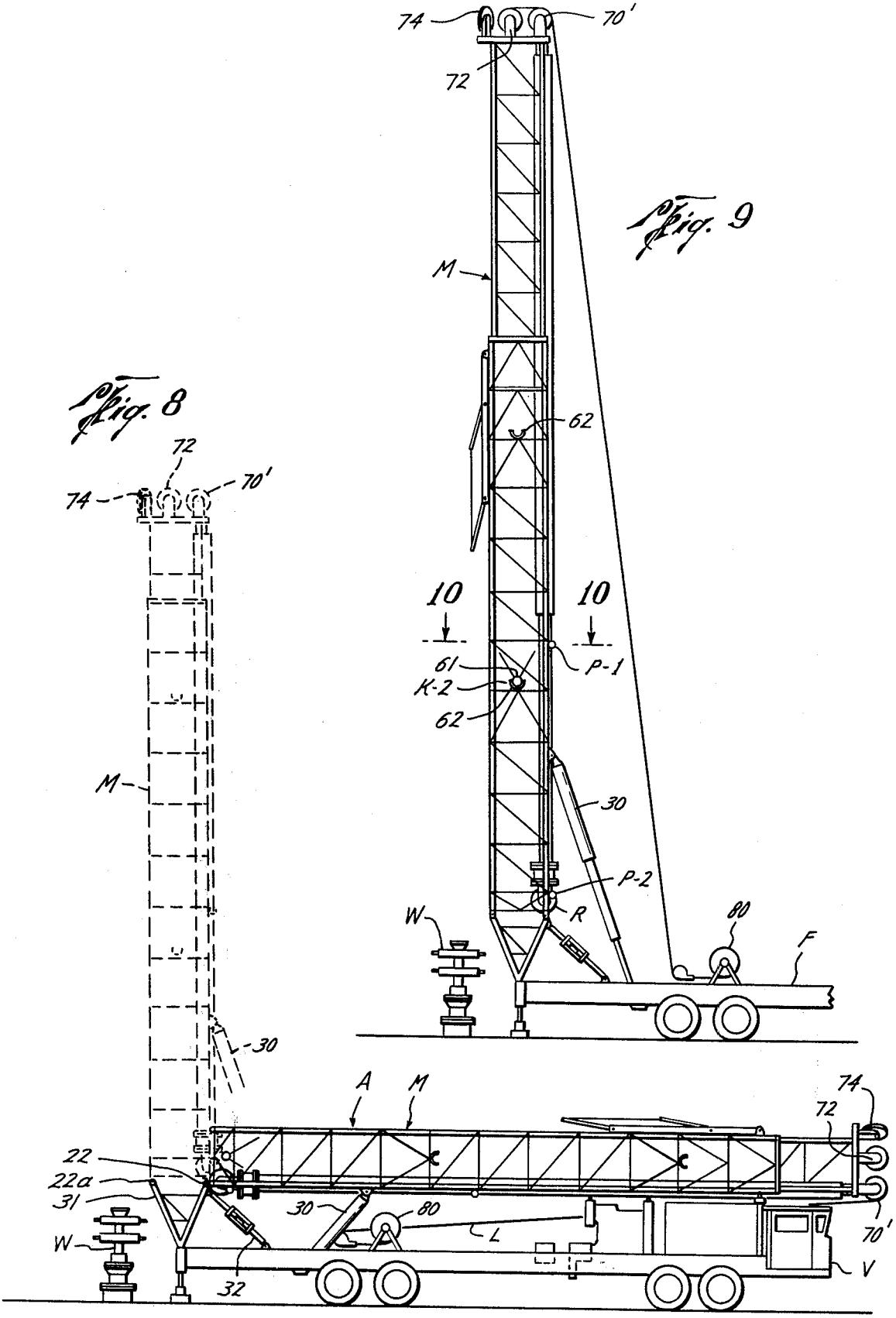
FIG. 8 is a view of the rig of the present invention in the telescoped condition, with the rig shown in solid lines in the horizontal position for transportation on the vehicle, and in dotted lines for extending to the position of FIG. 1.
FIG. 9 is a view illustrating an intermediate telescoped position of the mast during either extension or telescoping of the mast.

The lower end of the mast leg units of the lower mast section M-2 is pivotally connected to the rig floor or bed F of the vehicle V so that the entire rig A may be pivoted from the substantially horizontal position (solid lines in FIG. 8) to the upright position of FIG. 8 (dotted lines). The pivotal mountings 22 (FIG. 3) are conventional and are merely schematically illustrated. The mast M is raised and lowered from its travelling position to its upright use position by any suitable means such as the hydraulically actuated hoisting cylinder assembly 30 shown in FIGS. 1 and 8. Preferably, the lower end of the mast M has a lower support 31 which is secured to the rig or floor F and to which the pivoted connections at 22 attach so that the forward pivoted connection 22 may be released for pivoting the mast M from the upright position to the travelling position (FIG. 8). A turnbuckle assembly 32 is preferably secured to such mounting assembly 31 so as to adjustably position it at the proper angle for the cantilevering of the mast M, as will be more evident hereinafter.

It is to be noted that the rear portion of the vehicle V has conventional jack-type support members 35 which are disposed in proximity to the mast M for supporting a portion of the weight of the mast M during the actual use of the rig A on or in connection with a well W. It will be understood that such jack-type support members 35 are removed or retracted when the mast M has been placed in the travelling position and it is desired to move or convey the rig A to another location.

Considering now the details of the preferred hydraulic system H as illustrated in particular in FIG. 6, the hydraulic system H includes an hydraulic cylinder 40 which is preferably connected to the plate or plates 15 located at the upper end of the upper mast section M-1 (FIGS. 1 and 6). Such connection is preferably a releasable one involving a clevis **40*a* which receives a lug 15*a* that is welded or is otherwise secured to the plate or plates 15. A releasable pin 40*b* extends through suitable openings in the lug 15*a* and the legs of the clevis 40*a* (FIG. 6). Therefore, when it is desired to repair or replace the hydraulic assembly H, the entire hydraulic assembly H may be removed by the removal of the pin 40*b***.

A piston 42 is disposed within the cylinder 42 and it has suitable seal rings or piston rings **42*a* therewith in any known conventional manner, such being illustrated as openings in FIG. 6 for the purpose of receiving such rings or seals 42*a*. The piston 42 is connected to a ram or piston stem 43 which projects outwardly of the lower end of the cylinder 40 through a cylinder seal 41 which has suitable internal sealing rings 41*a*, schematically illustrated as openings in FIG. 6. The seal 41 is releasably held in position at the lower end of the cylinder 40 by a removable disk 40*c* which is removably connected to an annular flange 40*d* by removable bolt 40*e* having nuts 40*f* therewith. Flange 40*d* is welded or is otherwise secured to the lower end of the cylinder 40** as seen in FIG. 6.

The lower end of the ram or stem 43 is suitably connected to the ram sheaves generally indicated by the letter R in FIG. 6. A plurality of sheaves 45, which includes sheaves **45*a*, 45*b*, 45*c* and 45*d*, are rotatably mounted on an axle or shaft 44*a* which is mounted in a sheave support 44*b*. A cylinder or other upstanding member 44*c* is welded or is otherwise connected to a substantially horizontal plate 44*d* which is a part of the sheave support, and the central opening within the cylinder 44*c* is large enough to receive the enlarged lower end 43*a* of the ram 43. A retainer ring or bar 44*e* is releasably connected to the upper end of the cylinder 44*c* by releasable bolts 44*f*. Such ring or bar 44*e* confines the enlarged end 43*a* of the ram 43 so that the movement of the ram 43** is transmitted to the sheave assembly R.

The hydraulic assembly H is longitudinally aligned with the rear legs of the mast M (FIGS. 1 and 10) and preferably T-shaped guide rails are longitudinally disposed on the internal portion of each of the mast leg units near the rearward portion, such guide rails being designated 46 in the drawings. A guide sleeve 47 is welded or is otherwise secured to each side of the sheave support member **44*b* for receiving and sliding relative to the guide rails 46. As will be more evident hereinafter, the ram sheave assembly R is adapted to move longitudinally along the guide rails 46 from its uppermost position shown in FIG. 1 to its lowermost position shown in FIG. 9. It will be understood that the stroke of the ram 43 is determined by the length thereof and therefore may be varied for controlling the raising and lowering of the travelling block T. When the mast M is in its extended use position or length, as seen in FIG. 1, the lower end of the cylinder 40 is releasably secured to the upper end of the lower mast section M-2 by a substantially U-shaped clamping member 48 which is adapted to receive a clamping bar 49 and which has threaded ends for receiving releasable nuts 48*a*. The clamping bar 49 is preferably welded or is otherwise secured to the cross-bracing 21 (FIG. 2). As will be more evident hereinafter, such clamping member 48** is removed at the proper time during the telescoping of the mast M.

For the purposes of telescoping and extending the mast M, the ram sheave assembly R is releasably secured to the lower mast section M-2 at two releasable stop positions P-1 and P-2 (FIGS. 1 and 9). As illustrated in FIG. 11, the stop means for releasably stopping or holding the ram sheave assembly R at such stop positions P-1 and P-2 includes a hydraulically actuated stop pin 50 which is normally retracted within a hydraulic cylinder 51, but which can be actuated by the introduction of hydraulic fluid through hydraulic line **51*a* to move the stop pin from the solid line position of FIG. 11 to the dotted line position 50' so as to engage beneath the guide sleeve 47 thereby to prevent further downward relative movement of the sheave assembly R relative to the lower mast section M-2. A release of the pressure in the cylinder 41, or a reversal of the pressure by suitable hydraulic connections retracts the pin 50** to permit the relative downward movement of the sheave assembly R with respect to the lower mast section M-2.

Referring now to the latch means K which is adapted to support the upper mast section M-1 relative to the lower mast section M-2 at the fully extended position K-1 (FIG. 1) and also at an intermediate or intermediate positions K-2 (FIG. 9), one portion of such latch means K is carried at the lower end of the upper mast section M-1 (FIG. 12). As illustrated therein, the portion of the latch means K which is connected to the lower end of the upper mast section M-1 includes a hollow sleeve or tube 60 which is secured to the plate or strip 16 at the lower end of the mast section M-1 by longitudinally extending connecting members 16*a* which are welded or are otherwise secured to both the plate 16 and the sleeve or tube 60. The sleeve 60 is adapted to receive two latch pins 61 for lateral sliding movement within the bore of the sleeve or tube 60 from a retracted position (dotted lines in FIG. 12) to an extended latching position 61' (dotted lines in FIG. 12).

When the pins 61 are in the latching position 61', they rest upon and extend over latch seats 62 which are preferably substantially U-shaped and which are welded or are otherwise secured to laterally extending frame members 19.

The latch pins 61 may be suitably actuated hydraulically or mechanically by any suitable means, but as illustrated in particular in FIG. 12, a mechanical arrangement is preferred, wherein a pivoted central bar 63 has a pivot pin 63*a* extending therethrough and also through the sleeve 60 and to which is also attached an operating lever 64. Two links 65 are disposed pivotally at opposite ends of the pivoted lever 63, and each is pivotally connected to one of the latching pins 61 through a suitable slot or opening 60*a* in the sleeve 60. A spring 66 is connected to the outer end of the operating lever 64 and also to the plate or bar 16 so as to normally urge the lever 64 to an upper position (dotted lines in FIG. 12) so that the pins 61 are normally urged to their latching position 61'. For retracting the pins 61 to the retracted position shown in FIG. 12 in solids lines, a line or cable 67 is also fastened to the operating lever 64 so that upon a downward pulling of the line 67, the operating lever 64 is moved from its dotted line position of FIG. 12 to its solid line position.

Figure 4:
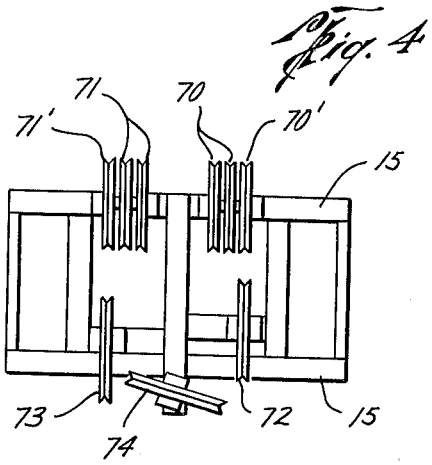
FIG. 4 is a plan view taken on line 4—4 of FIG. 3 to illustrate the preferred arrangement for the crown block assembly located at the top of the telescoping mast in the present invention.
Figure 5:
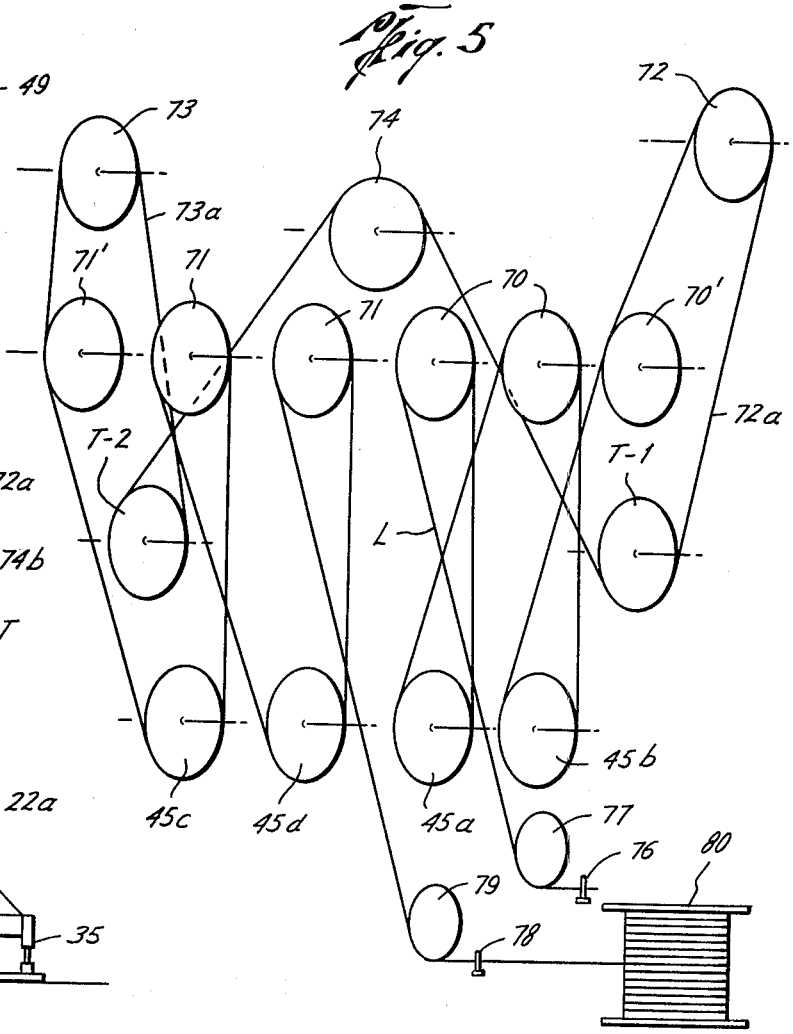
FIG. 5 is a schematic illustration, illustrating the manner in which the operating lines extend from the deadlines to the travelling block, by reeving over the crown blocks and the ram blocks.

Referring now to the crown sheaves at the upper end of the upper mast section M-1 (FIG. 4), there are two sets of rear crown sheaves 70 and 71 for the purposes of increasing the mechanical advantage, it is preferable to provide at least three rear crown sheaves 70 and at least three rear crown sheaves 71. The outermost rear crown sheave 70, designated 70' is in line with a forward crown sheave 72 mounted near the forward part of the mast section M-1. Similarly, the outermost rear crown sheave 71, designated 71' is in line with another forward crown sheave 73 which is located at the forward or well side of the mast section M-1. The advantage of such in-line arrangement of the sheaves is that the portion of the line L to the travelling block T may be well forward of the mast section M-1 and M-2 and further, the entire assembly of sheaves 72, 73 and also a cross-over sheave 74 at the forward portion of the mast section M-1 may be moved towards or away from the two sets of rear crown sheaves 70 and 71 while maintaining the alignment of the line L. Such arrangement allows for the same basic string-up of the line L, as will be more fully explained, on mast or derricks of different thicknesses from front to back so that sheave diameters do not determine the position of the travelling block. It is to be noted that the crown sheave 72 is displaced slightly rearwardly of the crown sheave 73 so that the portions of the line L extending to and from the travelling block T over the two sheaves in the travelling block T remain substantially parallel to each other as best seen in FIG. 1. Referring now to FIG. 5, the string-up of the line L is illustrated with the sheaves displaced from each other and schematically illustrated to facilitate understanding. The line L is a single continuous line that has its terminal ends dead-ended at the rig floor F, utilizing suitable dead-end clamps such as schematically illustrated at 76 and 78 in FIG. 5. Guide sheaves 77 and 79 are respectively used for guiding the terminal ends or dead ends of the line L to the suitable clamps 76 and 78. Further, as will be more evident hereinafter, the present invention also includes a manually or mechanically operated takeup reel 80 mounted on the floor F for taking up the slack in the line L when the mast sections are telescoped and for paying out the line L when the mast sections are extended. Such takeup of the line L prevents it from becoming tangled during the telescoping and extending of the mast M.

The string-up as illustrated in FIG. 5 can best be traced by starting from the dead-end 76 where it can be seen that the lines L is reeved around the innermost rear crown sheave 70, then around the ram sheave 45*a*, then around the intermediate sheave 70, then around the ram sheave 45*b*, then over the outermost crown sheave 70' to the forward crown sheave 72. From the crown sheave 72, the line drops downwardly on the well side of the mast M to the innermost sheave or pulley on the travelling block T, and then the line is reeved upwardly over the cross-over block 74 and again comes downwardly over the other sheave or block T-2 of the travelling block T, and from there it returns upwardly over the forward crown sheave 73. The line L is then reeved rearwardly from the forward sheave 73 over the outermost rear crown sheave 71' then extends downwardly to the ram sheave 45*c*, then back upwardly over the intermediate rear crown sheave 71, and then returns back down to the ram sheave 45*d* and then back up over the innermost rear crown sheave 71, and from there the line L extends downwardly to the guide sheave 79 and the dead-end clamp 78, and ultimately to the takeup reel 80. It is to be noted that 80 is not a drawworks and does not control the raising and lowering of the travelling block T, since such raising and lowering is controlled by the lowering and raising of the ram block assembly R, as will be more evident hereinafter. Under normal operating conditions, the dead-end clamps 76 and 78 are both engaged and it is only when telescoping or extending the mast M that the takeup reel is utilized.

In FIG. 7, the hydraulic system preferably used with the rig A of this invention is illustrated schematically. A conventional open center four-way valve 82 is used as the control valve. When valve 82 is in the center position as shown in FIG. 7, both sides of the piston 42 are blocked off from fluid flow from the cylinder 40 so that neither the ram sheaves R nor the travelling block can move. To raise the travelling block T, the valve 82 is shifted so that the crossing lines illustrated at 82*a* are then in the center position so that hydraulic fluid from the pump 83 flows through line 83*a* to line 84*a*, and then through a pilot operated check valve 84 so as to apply pressure in the area 40*g* above the piston 42. The area 40*h* below the piston 42 is connected to line 83*b* so that when the valve is in the cross-over position 82*a*, the fluid returns through line 85*a* to the tank 85 which is the supply for the pump 83.

When the valve 82 is shifted to the right as viewed in FIG. 7 so that the flow line 82*b* are in alignment, then the fluid from the pump 83 flows through line 83*a* to line 83*b* for applying pressure in the area 40*h* below the piston 42, and the fluid in the area 40*g* returns therefrom to the tank 85 through lines 84*a* and 85*a*. Under such condition, the ram sheave R is raised which causes a corresponding lowering of the travelling block T.

It should be understood that although the valve 82 is illustrated as a sliding valve from explanation purposes, it could be any kind of a rotating valve or other valve for movement to the three positions illustrated in FIG. 7. Also, the pilot operated check valve 84 is preferably utilized to prevent fluid from leaving the cylinder area 40*g* above the piston 42 until the pressure in the area 40*h* is high enough to open the check valve. Such check valve is conventional and the connecting line 84*b* illustrates the pilot line for controlling the opening of the valve 84 under such conditions. Thus, when the pressure of the hydraulic fluid in 40*h* is high enough, with the valve 82 in position with the ports 82*b* aligned, then the check valve 84 opens to allow the fluid in the cylinder area 40*g* to flow therefrom and return to the tank 85. When there is weight on the travelling block T, such check valve construction and arrangement provides better control than just the valve 82 alone. A pressure relief valve 86 connects with the cylinder area 40*h* to prevent the fluid pressure therein from becoming excessive due to shock loads when the valve 82 is operated too quickly or for whatever reason. Such valve 86 is not essential to the system, but prevents collapse of a hollow ram 43 in case someone disables the main relief valve and allows too much pressure into the area 40*g*. The system also includes a conventional relief valve 87 with the pump for circulation when the valve 82 is closed, and suitable filters 83*c*, and 83*d* and 85*b* are shown for obvious reasons. The pump 83 is shown as being operated by a motor or other drive means 83*e*. It will be understood that the various tanks 85 illustrated in FIG. 7 may be a common tank or may be interconnected tanks, all furnishing a supply to the pump 83.

On the forward side of the mast M, a conventional rod hanger 90 is preferably provided, and a tubing board 91 is also provided. It will be appreciated that these may be suitably arranged in any suitable manner so that they may fold flat to the condition shown in FIG. 8 for transportation purposes.

In the operation or use of the rig A of this invention, the mast is transported in the telescoped position or length illustrated in FIG. 8 so that it is of substantially the same length as the vehicle V used for such transportation. When the rig A has arrived at the well W and has been positioned with the rear leg supports 35, and any other suitable bracing (not shown), the mast is raised by actuating the hydraulic cylinder hoist 30 so as to pivot the mast about the pivots 22 for each of the lower mast leg units of the lowermast section M-2. Since the uppermast section M-1 is telescoped within the lower mast section M-2, the entire mast M is thus raised to its upright, slightly cantilevered position shown in dotted lines in FIG. 8, at which point the forward releasable connections 22*a* are coupled together to secure the mast M to the base 31. The turnbuckle 32 may at that point be adjusted for the proper angle of cantilever or inclination so that the travelling block T is disposed for vertical travel to one side of the mast M in its operating position (FIG. 1).

For raising the upper mast section M-1, the hydraulic system H is utilized. As best seen in FIG. 8, the ram is in the retracted position during transportation and thus starts in retracted position when it is first moved to the upright position of FIG. 8. The ram stop pin 50 as shown in FIG. 11 is actuated to the stop position shown at 50' for stop position P-2 which prevents the ram sheave assembly R from moving downwardly. The valve 82 is then operated to move it to the position indicated at 82*a* so that the hydraulic pressure is developed in the cylinder area 40*g* above the piston 42. Since the cylinder 40 is connected to the upper end of the upper mast section M-1, and since the lower end of the ram 43 is secured to the lower end of the mast section M-2, the pressure in the cylinder area 40*g* causes the upper mast section M-1 to rise relative to the lower mast section M-2.

When the upper mast section M-1 is thus being raised, the latch pins 61 are held in their retracted position by a downward pull on the line 67 (FIG. 12). However, when the latch assembly K reaches the intermediate latch position K-2, the pressure on the line 67 is released so that the spring 66 urges the levers 64 and 65 to an outward position to thereby move the latch pins 61 outwardly to the latching position 61'. This occurs when the pins 61 are above the latch seats 62, so that to seat the pins 61 in the seats 62, the valve 82 is again shifted so as to position the valve with the flow lines 82*b* in the flow stream which causes the cylinder 40 to lower slightly and thus seat the pin s 61 on the latch seats 62.

Just before such reversal of the valve 82, or at approximately the same time, the stop pin 50 is retracted to its solid line position of FIG. 11 so that the pressure developed in the solid area 40*h* causes the ram 43 and the ram sheave assembly R to move upwardly relative to the cylinder 40. Such upward travel of the ram 43 continues until the ram sheave assembly R has reached the intermediate stop position P-1, at which point the stop pin 50 at that location is actuated. The valve 82 is then moved to the extend position 82*a* so that pressure is again developed in the cylinder area 40*g*. When the latch pins 61 reach the upper seats 62 at the fully extended position K-1 (FIG. 1), the pins 61 again are urged outwardly by the spring 66 and seat upon the latch seats 62. The valve 82 is again shifted to align the ports 82*b* with the flow lines so that fluid pressure is developed in the cylinder area 40*h* to assure the seating of the pins 61 in the latch seats 62 at the upper position K-1. The stop pin 50 is released from the stop position P-1 so that thereafter, the ram 43 and the ram sheave assembly R may move for substantially the full length of the lower mast section M-2 for conducting normal operations with the traveling block T.

As best seen in FIG. 1, when the ram sheave assembly R is in its uppermost position, near the upper end of the lower mast section M-1, the travelling block T is at its lowermost position in proximity to the well W. Upon introducing fluid pressure into the cylinder area 40*g*, the ram sheave assembly R is moved downwardly, causing the travelling block T to move upwardly. Due to the multiple reeving of the line L, the travelling block T may move two or more times the distance of the movement of the ram sheave assembly R. Thus, as illustrated, the ram sheave assembly R moves approximately half the full length of the mast M, whereas the travelling block T moves approximately the full length of the mast M.

It should be noted that as the mast M was being extended in the manner heretofore described, the operating ling L was gradually payed out from the takeup reel 80 by releasing the clamp 78 (FIG. 5). In that manner, the proper amount of the line L is provided, and then the clamp 78 is secured to provide the deadline for the operating line L.

When it is desired to telescope the mast M, the reverse procedure to that described above occurs. Thus, the ram sheave assembly R is moved to the stop position P-1 and the stop pin 50 is actuated at that location. Then, the latch pins 61 are retracted by pulling downwardly on the line 67. With the valve 82 in the position 82*a*, together with the weight of the mast M-1, the cylinder 40 moves downwardly relative to the ram 43 until the lower end of the upper mast section M-1 reaches the intermediate position K-2 (FIG. 9), at which point the pins 61 are released to their latching position. The stop in 50 is then released to permit the ram 43 and the ram sheave assembly R to move downwardly to position P-2, at which point the stop pin 50 at P-2 is actuated, and then the pins 61 are released so that the upper mast section M-1 may move from the intermediate position K-2 to the fully telescoped position (FIG. 8). The connecting pins 22*a* are then released and the entire mast M is pivoted, using the hydrualic hoist 30 to the substantially horizontal travelling position joining solid lines in FIG. 8. During such retraction or telescoping of the mast M, the takeup reel 80 takes up any slack in the line L so as to prevent tangling of such line L.

One of the features of the present invention is the substantially equalized loading on the rear and forward legs of the mast M, even though the travelling block T extends forwardly of the mast M. This is accomplished by means of the deadline connections of the line L at 76 and 78 on the opposite side from the travelling block T and at an angle to vertical as best seen in FIG. 1. To more readily understand the reeving of the lines L from the crown blocks to the travelling block T, portions of such line L have been further identified as follows: The portion of the line L extending downwardly from the crown block 72 to the travelling block T-1 is designated 72*a*, the portion of the line L extending upwardly from the block T-1 to the crossover sheave 74 is designated 74*a*, the portion of the line L from the crossover block 74 to the travelling block T-2 is designated 74*b* and a portion of the line L from the block T-2 upwardly to the sheave or block 73 is designated 73*a*. For clarity, parts of the line portions 72*a*, 74*a*, 74*b* and 73*a* have been omitted in FIG. 3.

Figure 13:
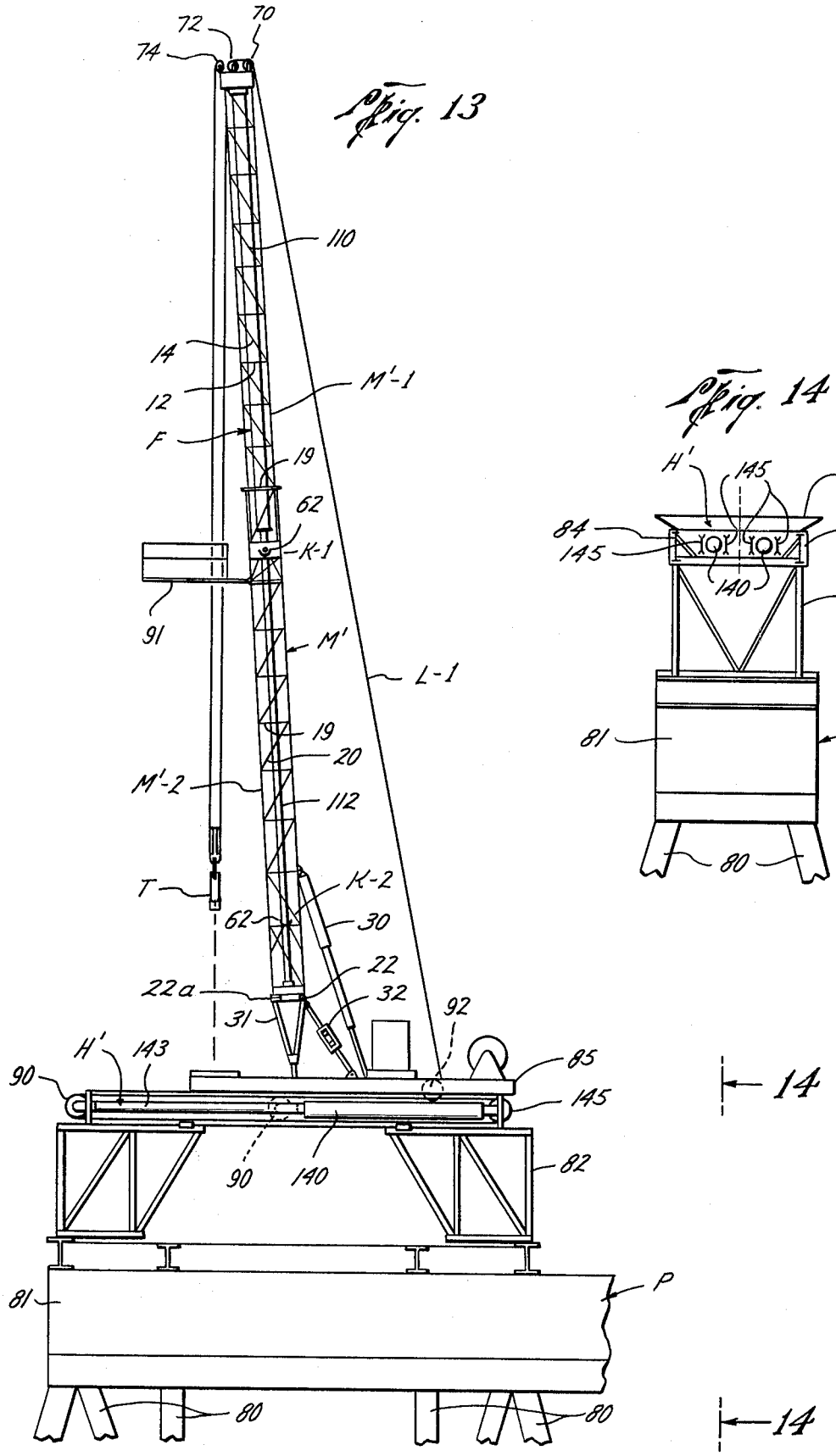
FIG. 13 is an elevation of a modified rig of the present invention which is particularly suitable for use offshore on a fixed or movable platform.
Figure 14:
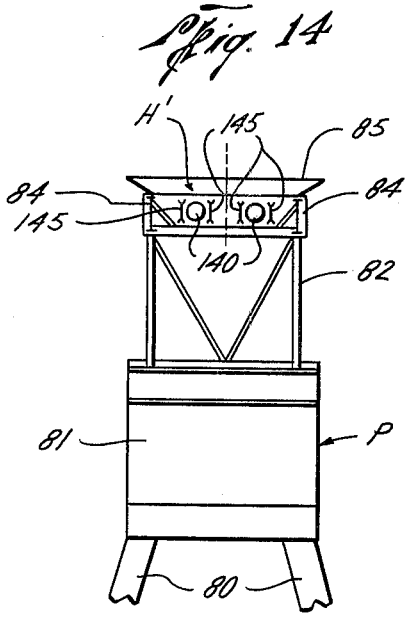
FIG. 14 is a partial end view taken on line 14—14 of FIG. 13.
Figure 15:
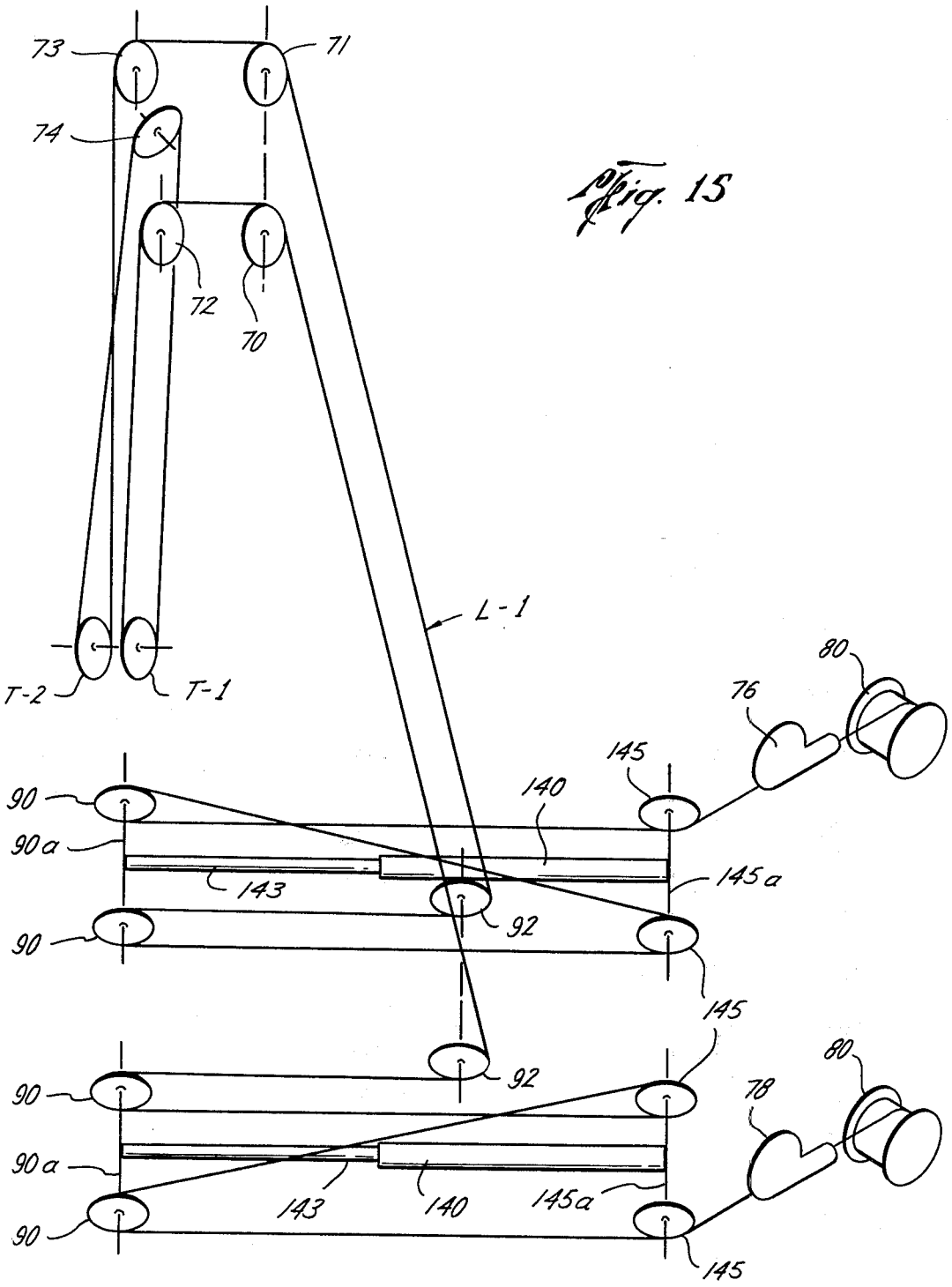
FIG. 15 is a schematic illustration of the manner in which the operating lines are connected in the modified rig of FIGS. 13 and 14.

In FIGS. 13–15, letter A-1 refers generally to a modified form of the rig of this invention which may be used at a land location, but which is particularly suitable for use on a fixed or movable offshore platform such as partially indicated by the numeral P. It will be understood that the platform P, if of the fixed type, has a plurality of legs 80 which extend from the main platform deck 81 downwardly into the bottom of the body of water in which the platform P is located. If the platform P is of the movable type, the legs 80 extend downwardly to a flotation member (not shown) of any well known construction.

A sub-assembly 82 is mounted on the deck 81 and supports a rig floor or base 85, with conventional support members such as I-beams 84 positioning the floor 85 with a space for receiving the hydraulic system H which preferably is a pair of hydraulic cylinder and piston assemblies, each having a cylinder 140 and a piston ram or stem 143, the construction of which preferably corresponds with the cylinder 40 and piston ram or stem 43, respectively, and the parts associated therewith which is heretofore described in connection with FIG. 6. It is to be noted that the hydraulic system H′ is substantially horizontal rather than substantially vertical as in the hydraulic system H, and each assembly 140, 143 is positioned to one side of the center of the rig floor 85 to permit the usual drill pipe and other equipment to pass through the center of the rig floor, as will be well understood.

Except for hydraulic system H′ and the arrangement of the operating lines L-1 with such system H′ in FIGS. 13–15, and the means for telescoping and extending the mast, the rest of the structure, such as the mast M′ may be the same as those illustrated in FIGS. 1–4 and 6–12, and like parts therefore bear like numbers or letters.

As best seen in FIG. 15, each cylinder 140 has a pair of sheaves 145 operably mounted on a shaft 145*a* which is welded or otherwise affixed to the cylinder 140. Each of the ram stems or rods 143 likewise has a pair of sheaves 90 operably mounted on a shaft 90*a* which is welded or otherwise affixed to the ram stem or rod 143.

Additional guide sheaves 92 are also provided with the modified rig of FIGS. 13–15. The string-up of the operating line L-1 is shown in FIG. 15. Briefly, the line L-1 is dead-ended at suitable adjustable clamps 76 and 78, either or both of which is preferably connected with a take-up spool for the excess line. The end of the line L-1 runs from the clamp 78 to one sheave 145, then to one sheave 90, crossing over to the other sheave 145 and then back to the sheave 90. The line then passes over one of the guide sheaves 92 and extends upwardly to rear crown sheave 70, front crown sheave 72, travelling block T-1, cross-over sheave 74, travelling block T-2, front crown sheave 73, rear crown sheave 71 and then back down to the other guide sheave 92, and the sheaves 90, 145, 90 and 145 of the other hydraulic assembly and finally to the clamp 76 and the take-up spool 80 therewith.

The operation or use of the modified rig of FIGS. 13–15 is similar to that of the rig of FIGS. 1–12. Thus, by the inlet and outlet of hydraulic fluid to the cylinders 140 in any known manner the cylinders 140 move relative to the rams or rods 143 which are secured against movement. Whether the cylinders 140 move and rods 143 remain fixed, or vice-versa, is optional. As the sheaves 90 move from their retracted position (dotted lines in FIG. 13) to their extended position (solid lines in FIG. 13), the travelling block sheaves T-1 and T-2 and the block T therewith move upwardly, and movement of the sheaves 90 in the opposite direction allows the travelling block T to move downwardly.

It should be noted that the hydraulic system H′ in FIGS. 13–15 does not serve to telescope or extend the mast M′. Instead, a separate hydraulic unit F of any suitable construction is mounted in the mast M′. It includes a cylinder 110 with suitable fluid inlet and outlet openings and a source of hydraulic fluid, as is well known, for imparting relative longitudinal movement between the cylinder 110 and a piston and stem 112. The upper end of the cylinder 110 is secured by welding or otherwise to the upper part of the upper mast section M'-1. The lower end of the stem 112 is secured to the lower part of the lower mast section M'-2. Thus, when the hydraulic unit F is extended, the mast M' may be locked in its extended position K-1 in the same manner as described in connection with FIGS. L-12. Likewise, the mast M' may be lowered to its telescoped position K-2, seated and locked as described in connection with FIGS. 1-12. The telescoping feature is desirable when the mast M' is moved from one location to another.

The foregoing disclosure and description of the invention are illustrative and explanatory thereof, and various changes in the size, shape and materials as well as in the details of the illustrated construction may be made without departing from the spirit of the invention.

We claim:

1. A portable hydraulic rig, comprising:

a rig mast having an upper mast section and a lower mast section which are adapted to telescope from an extended use length to a telescoped transport length and to also extend from the telescoped transport length to the extended use length relative to each other;

a hydraulic system including a hydraulic ram mounted with said mast and having an operating deadline connected with the hydraulic ram and with a travelling block;

said hydraulic ram having a ram part which is longitudinally movable relative to said mast for raising and lowering the travelling block relative to the mast when said ram is moved longitudinally downwardly and upwardly, respectively, to perform various operations on or in conjunction with a well; and means including a means for releasably connecting said longitudinally movable ram part of the hydraulic ram to the mast for controllably telescoping or extending the mast sections with the hydraulic system when said ram part is connected to one of the mast sections.

2. The rig set forth in claim 1, including:

means for mounting said mast in an upright position, cantilevered from vertical, when in its extended use length for disposing the travelling block for vertical travel to one side of said mast; and means for making the deadline connection of said terminal ends of said operating deadline on the other side of the mast from said travelling block to substantially equalize the loading on the mast legs.

3. The rig set forth in claim 1, including:

a rig mast having an upper mast section and a lower mast section which are adapted to telescope from an extended use length to a telescoped transport length and to also extend from the telescoped transport length to the extended use length relative to each other;

a hydraulic system mounted with said mast and having an operating line connected therewith and with a travelling block for raising and lowering the travelling block relative to the mast to perform various operations on or in conjunction with a well;

means for releasably connecting a longitudinally movable part of said hydraulic system to said mast for controllably telescoping or extending the mast sections with the hydraulic system including a hydraulic ram; and stop means for releasable securing said ram to said lower mast section at at least one point for effecting the telescoping or extension of said mast sections.

4. The rig set forth in claim 3, including:

releasable latch means on said mast sections for releasably supporting said mast sections at the extended length.

5. The rig set forth in claim 3, including:

releasable latch means on said mast sections for releasably supporting said mast sections at the extended length and also at an intermediate position between the telescoped and extended length.

6. The rig set forth in claim 5, including:

rear legs forming part of said lower mast section; and guide means extending between said ram and the lower section of said mast for guiding same along said rear legs of said lower mast section.

7. A portable hydraulic rig, comprising:

a rig mast having an upper mast section and a lower mast section mounted on a rig floor which are adapted to telescope from an extended use length to a telescoped transport length and to also extend from the telescoped transport length to the extended use length relative to each other;

a hydraulic system including a hydraulic ram with said mast;

an operating deadline having each of its terminal ends connected to a fixed base; and said operating deadline being reeved on the hydraulic ram and a travelling block for raising and lowering the travelling block relative to the mast while the length of the operating line in use remains constant during the raising and lowering of the travelling block.

8. The rig set forth in claim 2, including:

line take-up means on said rig floor for taking up the slack in said operating line as the mast is telescoped from its extended use length to its telescoped transport length.

9. A portable hydraulic rig, comprising:

a rig mast having an upper mast section and a lower mast section which are adapted to telescope from an extended use length to a telescoped transport length and to also extend from the telescoped transport length to the extended use length relative to each other;

a hydraulic system including a hydraulic ram with said mast and having an operating line connected with the hydraulic ram and with a travelling block having at least two travelling block sheaves for raising and lowering the travelling block relative to the mast to perform various operations on or in conjunction with a well;

a crown block assembly mounted at the upper end of said upper mast section;

said crown block assembly comprising:

at least one pair of rearward crown sheaves secured to the rear portion of upper mast section for the reeving of the lines from said hydraulic system;

at least one pair of forward crown sheaves secured to the forward portion of upper mast section for the reeving of lines from said travelling block and from said rearward crown sheaves, each of said forward crown sheaves being substantially horizontally aligned in substantially the same vertical plane with at least one rearward crown sheave;

said operating line reeved in a substantially horizontal straight line from each of said aligned rearward crown sheaves to one of the aligned forward crown sheaves and then in a substantially vertical line to the travelling block;

a cross-over sheave between said forward crown sheaves; and said operating line being reeved from one travelling block sheave over the cross-over sheave to another travelling block sheave.

10. The rig set forth in claim 9, wherein:

said hydraulic system has a cylinder connected to the upper end of said upper mast section, and a piston operated ram therewith movable by hydraulic fluid; and said ram having at least one sheave at its lower end over which said operating line is reeved so that upon lowering said ram, said travelling block is raised and vice versa.

11. The rig set forth in claim 9 including:

a vehicle for mounting said mast thereon; and means for pivotally mounting the lower mast section on said vehicle for pivoting same from an upright use position to a substantially horizontal travelling position.

12. The rig set forth in claim 11, wherein:

said operating line has its terminal ends connected to the vehicle; and line take-up means are mounted on the vehicle for taking up the slack in the operating line when the rig mast is telescoped and pivoted to the substantially horizontal travelling position on the vehicle.

13. The rig set forth in claim 9, wherein:

said lower mast section comprises two lower longitudinal mast leg units which are laterally spaced apart; and said upper mast section comprises two upper longitudinal mast leg units which are laterally spaced apart and which are of a smaller overall size than said lower leg units so that each upper leg unit is small enough to fit with the lower leg unit for longitudinal movement relative thereto.

14. The rig set forth in claim 13, wherein:

each of said lower leg units and said upper leg units has at least one rear leg and at least one forward leg; and means for cantilevering said mast and for securing said operating line for distributing the load on the travelling block to the rear legs and the forward legs.

15. An hydraulic rig for use with wells, comprising:

a mast having a plurality of longitudinal legs, a lower mast support, and an upper crown block assembly;

means connected to the mast for positioning it at an angle to vertical;

a travelling block operably supported from the crown block assembly by an operating line of a fixed length for vertical movement at an angle to said mast and laterally spaced therefrom;

a hydraulic system operably connected to said operating line for moving said travelling block upwardly and downwardly relative to said mast; and at least one portion of said operating line disposed on the opposite side of said mast from said travelling block and extending at an angle with respect to said mast for substantially evenly distributing a load on said travelling block to all of said legs.

16. The rig of claim 15, wherein:

said mast is formed in an upper section and a lower section;

said hydraulic system is disposed with said mast; and means connecting said hydraulic system to said mast for telescoping and extending said mast sections.

17. The rig of claim 15, wherein:

said hydraulic system is disposed substantially horizontally; and sheaves for guiding the operating line from said hydraulic system over said crown block assembly to said travelling block for imparting the upward and downward movements to said travelling block.

18. The rig of claim 17, wherein said hydraulic system includes:

a pair of hydraulic cylinder and piston assemblies disposed below said lower mast support; and each of said cylinder and piston assemblies having a pair of sheaves connected to said cylinder and a pair of sheaves connected to said piston, over which said operating line extends.

19. A portable hydraulic rig, comprising:

a rig mast having an upper mast section and a lower mast section which are adapted to telescope from an extended use length to a telescoped transport length and to also extend from the telescoped transport length to the extended use length relative to each other;

a hydraulic system with said mast and having an operating line connected therewith and with a travelling block for raising and lowering the travelling block relative to the mast to perform various operations on or in conjunction with a well;

a crown block assembly mounted at the upper end of said upper mast section;

said crown block assembly comprising:

at least one pair of rearward crown sheaves secured to the rear portion of upper mast section for the reeving of the lines from said travelling block;

a cross-over sheave between said forward crown sheave; at least one rearward crown sheave being aligned with each of said forward crown sheaves so that the operating line extending therebetween is reeved in a straight line;

said lower mast section comprising two lower longitudinal mast leg units which are laterally spaced apart;

said upper mast section comprising two upper longitudinal mast leg units which are laterally spaced apart and which are of a smaller overall size than said lower leg units so that each upper leg unit is small enough to fit with the lower leg unit for longitudinal movement relative thereto;

each of said lower leg units and said upper leg units having at least one rear leg and at least one forward leg;

means for cantilevering said mast and for securing said operating line for distributing the load on the travelling block to the rear legs and the forward legs;

laterally movable latch pins mounted on said upper mast near its lower end;

latch seats on said lower mast near its upper end for receiving said latch pins; and means for retracting said latch pins from their seated position on said latch seats for permitting longitudinal movement of said upper mast section relative to said lower mast section.

* * * * *